US009905174B2

(12) United States Patent
Jeong et al.

(10) Patent No.: US 9,905,174 B2
(45) Date of Patent: Feb. 27, 2018

(54) LIQUID CRYSTAL DISPLAY APPARATUS USING INVERSION DRIVING AND DRIVING METHOD THEREOF

(71) Applicant: SAMSUNG DISPLAY CO., LTD., Yongin, Gyeonggi-do (KR)

(72) Inventors: Jae Won Jeong, Seoul (KR); Kwan-Young Oh, Hwaseong-si (KR); Younjin Jung, Daejeon (KR); Kyung-Uk Choi, Gunpo-si (KR); Po-Yun Park, Seoul (KR); Sangyoung Lee, Hwaseong-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 56 days.

(21) Appl. No.: 14/620,933

(22) Filed: Feb. 12, 2015

(65) Prior Publication Data

US 2015/0302812 A1 Oct. 22, 2015

(30) Foreign Application Priority Data

Apr. 17, 2014 (KR) ..... 10-2014-0046178

(51) Int. Cl.
*G09G 3/36* (2006.01)

(52) U.S. Cl.
CPC ... *G09G 3/3614* (2013.01); *G09G 2310/0213* (2013.01); *G09G 2320/0209* (2013.01); *G09G 2320/0247* (2013.01)

(58) Field of Classification Search
CPC ... G09G 2310/0213; G09G 2320/0209; G09G 2320/0247; G09G 3/3614
See application file for complete search history.

(56) References Cited

U.S. PATENT DOCUMENTS

| | | | | |
|---|---|---|---|---|
| 2006/0097967 | A1 | 5/2006 | Lee | |
| 2008/0001890 | A1 | 1/2008 | Song et al. | |
| 2009/0122054 | A1* | 5/2009 | Lee | G09G 3/2055 345/214 |
| 2009/0195529 | A1 | 8/2009 | Nam et al. | |
| 2010/0149151 | A1 | 6/2010 | Nam et al. | |

(Continued)

FOREIGN PATENT DOCUMENTS

| | | |
|---|---|---|
| JP | 2000-235375 | 8/2000 |
| JP | 2001-174783 | 6/2001 |

(Continued)

*Primary Examiner* — Lun-Yi Lao
*Assistant Examiner* — Johny Lau
(74) *Attorney, Agent, or Firm* — F. Chau & Associates, LLC

(57) ABSTRACT

A liquid crystal display device includes a liquid crystal panel which includes gate lines, data lines crossing the gate lines, and pixels connected to the gate lines and the data lines; a timing controller for receiving a control signal and image data and for generating a gate control signal and a data control signal; a gate driver for generating a gate signal based on the gate control signal and outputting the gate signal to the gate lines; and a data driver for performing data conversion on the image data based on the data control signal and outputting a conversion result to the data lines, wherein the timing controller analyzes the image data frame by frame data and applies two or more inversion driving techniques to frame data.

18 Claims, 14 Drawing Sheets

(56) References Cited

U.S. PATENT DOCUMENTS

| | | | | |
|---|---|---|---|---|
| 2010/0207918 | A1 | 8/2010 | Lee et al. | |
| 2010/0214315 | A1 | 8/2010 | Nguyen et al. | |
| 2011/0037760 | A1 | 2/2011 | Kim et al. | |
| 2015/0243235 | A1* | 8/2015 | Inada ..... | G09G 3/3614 345/209 |

FOREIGN PATENT DOCUMENTS

| | | |
|---|---|---|
| KR | 1020040001688 | 1/2004 |
| KR | 1020100095180 | 8/2010 |
| KR | 1020110018722 | 2/2011 |

* cited by examiner

| FIG. 3A | FIG. 3 |
|---|---|
| FIG. 3B | |

| | |
|---|---|
| FIG. 8A | FIG. 8 |
| FIG. 8B | |

| FIG. 10A | FIG. 10 |
|---|---|
| FIG. 10B | |

LIQUID CRYSTAL DISPLAY APPARATUS USING INVERSION DRIVING AND DRIVING METHOD THEREOF

CROSS-REFERENCE TO RELATED APPLICATIONS

This application claims priority under 35 U.S.C. § 119 from Korean Patent Application No. 10-2014-0046178 filed Apr. 17, 2014, in the Korean Intellectual Property Office, and all the benefits accruing therefrom, the contents of which are herein incorporated by reference in their entirety.

BACKGROUND

Embodiments of the inventive concepts described herein are directed to a liquid crystal display device and a driving method thereof, and more particularly, are directed to a liquid crystal display device using inversion driving and a driving method thereof.

In a liquid crystal display device, the arrangement of liquid crystal molecules may be changed by forming an electric field across a liquid crystal layer disposed between two substrates. The transmissivity of incident light may be adjusted due to variations in the arrangement of the liquid crystal molecules, thereby displaying images.

Based on a phase of a data voltage applied to a data line, a method of driving a liquid crystal display device may be classified as line inversion, column inversion, or dot inversion. In line inversion, a phase of the image data being applied to a data line may be inverted every pixel row. In column inversion, a phase of the image data being applied to a data line may be inverted every pixel column. In dot inversion, a phase of the image data being applied to a data line may be inverted every pixel row and every pixel column.

To prevent crosstalk or flicker from being seen, line inversion may change appropriately based on the pattern of image data that causes the crosstalk or flicker according to a pixel structure of a display panel. This technique may be known as PDF (Pattern Detect Function).

SUMMARY

One aspect of embodiments of the inventive concept provides a liquid crystal display device comprising a liquid crystal panel that includes gate lines, data lines crossing the gate lines, and pixels connected to the gate lines and the data lines; a timing controller for receiving a control signal and image data and for generating a gate control signal and a data control signal; a gate driver for generating a gate signal based on the gate control signal and outputting the gate signal to the gate lines; and a data driver for performing data conversion on the image data based on the data control signal and outputting a conversion result to the data lines, wherein the timing controller analyzes the image data frame by frame and can apply two or more inversion driving techniques to the frame data.

In exemplary embodiments, the timing controller comprises an analyzing unit for analyzing the frame data line by line; a setting unit for setting a plurality of data areas that match a Pattern Detect Function (PDF) target pattern; and an applying unit for applying an inversion driving technique independently to each data area.

In exemplary embodiments, the setting unit sets the data areas using line data with the same PDF target pattern as a boundary.

In exemplary embodiments, the setting unit sets the data areas using pattern data with the same PDF target pattern as a boundary.

Another aspect of embodiments of the inventive concept provides a method of driving a liquid crystal display device, the method comprising analyzing a pattern type of line data of input frame data; setting a plurality of data areas that match a Pattern Detect Function (PDF) target pattern; and applying an inversion driving technique independently to each data area.

In exemplary embodiments, setting a plurality of data areas that match a PDF target pattern comprises determining whether a pattern type of the line data has changed; storing a start point of a data area, if the pattern type of the line data has not changed, the line data matches the PDF target pattern and a pattern of the line data is first recognized; and storing a type of the PDF target pattern of the data area and an end point of the data area, if the pattern type of the line data has not changed, the number of line data that matches the PDF target pattern is greater than a first setting value, and the number of data areas set is less than a second setting value.

In exemplary embodiments, setting a plurality of data areas that match a PDF target pattern further comprises determining whether the line data is a last line data of the frame data; and storing an end point of the last data area and a type of the PDF target pattern of the last data area, if the number of line data that matches the PDF target pattern is greater than a third setting value and the number of data areas set is less than the second setting value.

In exemplary embodiments, when the line data does not match the PDF target pattern or a pattern of the line data has been recognized, the method may comprise determining whether the line data is the last line data of the frame data.

In exemplary embodiments, when the number of line data that matches the PDF target pattern is less than the first setting value or the number of data areas set is greater than the second setting value, the method may comprise determining whether the line data is the last line data of the frame data.

In exemplary embodiments, when the line data does not match the PDF target pattern, the number of line data that matches the PDF target pattern is less than the third setting value, or the number of line data set is greater than the second setting value, the method may comprise applying an inversion driving technique independently to each data area.

In exemplary embodiments, setting a plurality of data areas that match a PDF target pattern comprises determining whether a pattern type of the line data has changed; storing first-direction and second-direction location information of a start point of a data area, where the first and second directions are orthogonal to each other, if a pattern type of the line data has not changed, the line data matches a PDF target pattern and a pattern of the line data is first recognized; and storing the first-direction and second-direction location information of an end point of the data area and a type of the PDF target pattern of the data area, if a pattern type of the line data has changed, the number of line data that matches the PDF target pattern is greater than a first setting value, and the number of data areas set is less than a second setting value.

In exemplary embodiments, setting a plurality of data areas that match a PDF target pattern further comprises determining whether the line data is a last line data of the frame data; and storing the first-direction and second-direction location information of an end point of the last data area and a type of the PDF target pattern of the last data area, if the number of line data that matches the PDF target pattern is greater than a third setting value and the number of data areas set is less than the second setting value.

In exemplary embodiments, when the line data does not match the PDF target pattern or a pattern of the line data has been recognized, the method may comprise determining whether the line data is the last line data of the frame data.

In exemplary embodiments, when the number of line data that matches the PDF target pattern is less than the first setting value or the number of data areas set is greater than the second setting value, the method may comprise determining whether the line data is the last line data of the frame data.

In exemplary embodiments, when the line data does not match the PDF target pattern, the number of line data that matches the PDF target pattern is less than the third setting value, or the number of line data set is greater than the second setting value, the method may comprise applying an inversion driving technique independently to each data area.

In exemplary embodiments, setting a plurality of data areas that match a PDF target pattern comprises determining whether a pattern type of the line data has changed; storing first-direction and second-direction location information of start and intermediate points of a data area, where the first and second directions are orthogonal to each other, if a pattern type of the line data has not changed, the line data matches a PDF target pattern and a pattern of the line data is first recognized; and storing the first-direction and second-direction location information of an end point of the data area and a type of the PDF target pattern of the data area, if a pattern type of the line data has changed, the number of line data that matches the PDF target pattern is greater than a first setting value, and the number of data areas set is less than a second setting value.

In exemplary embodiments, there may be a plurality of intermediate points.

Still another aspect of embodiments of the inventive concept provides a method of driving a liquid crystal display device, the method comprising analyzing a pattern type of line data of input frame data to determine a number of data that matches a Pattern Detect Function (PDF) target pattern; storing the line data as an object to which PDF is applied or as an object to which PDF is not applied; and applying an inversion driving technique independently to each line data.

In exemplary embodiments, storing the line data as an object to which PDF is applied or as an object to which PDF is not applied comprises determining whether the number of line data that matches a PDF target pattern is greater than a fourth setting value; storing the line data as an object to which PDF is applied, if the number of line data that matches the PDF target pattern is greater than the fourth setting value; and storing the line data as an object to which PDF is not applied, if the number of line data that matches the PDF target pattern is less than the fourth setting value.

In exemplary embodiments, storing the line data as an object to which PDF is applied or as an object to which PDF is not applied further comprises determining whether the line data is a last line data of the frame data. If the line data is the last line data of the frame data, the inversion driving technique is independently applied to each line data; if the line data is not the last line data of the frame data, a pattern type of line data of input frame data is analyzed to determine the number of data that matches a PDF target pattern.

DETAILED DESCRIPTION

Figure 1:
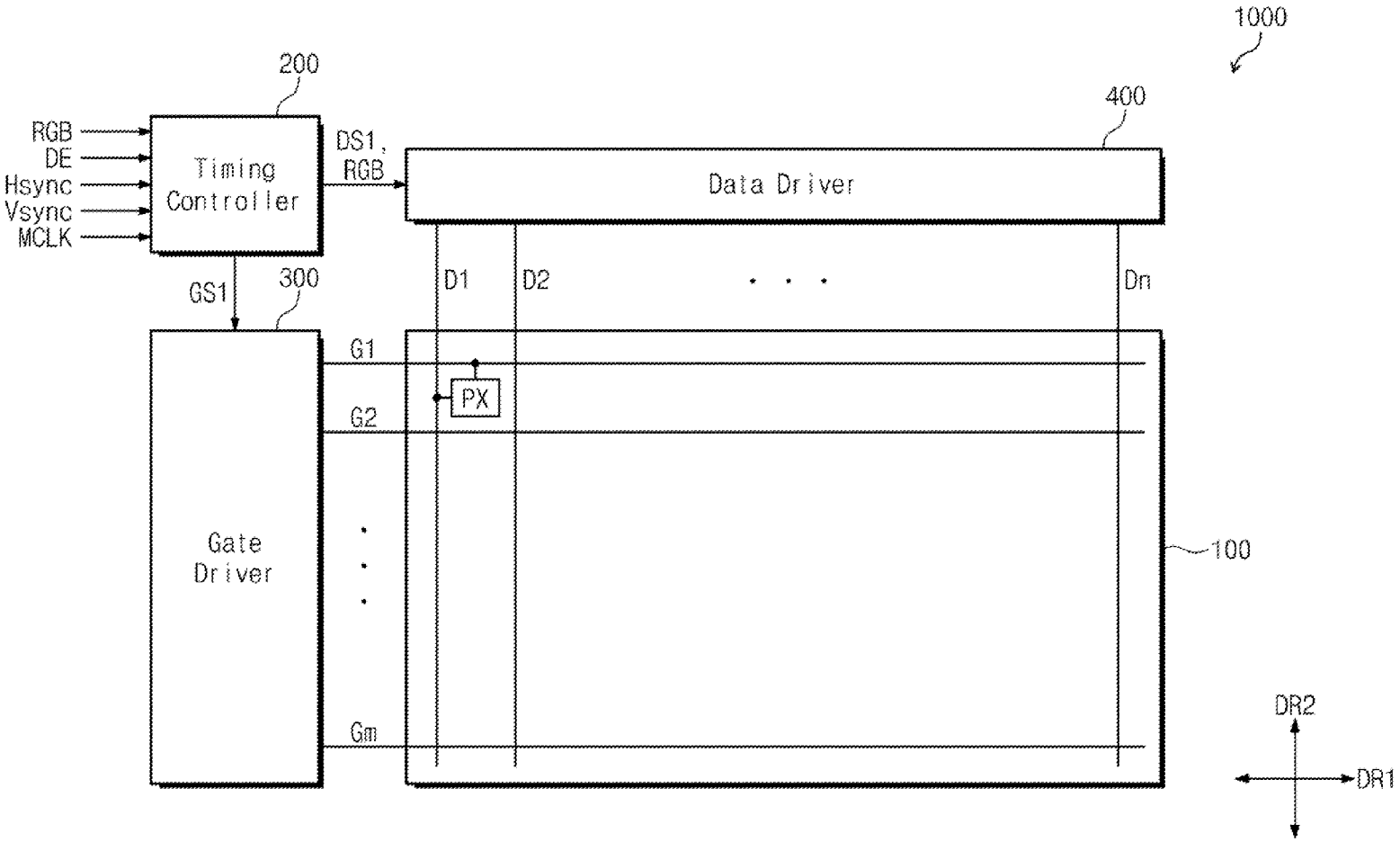
FIG. 1 is a block diagram that schematically illustrates a liquid crystal display device according to an embodiment of the inventive concept.

Embodiments will be described in detail with reference to the accompanying drawings. The inventive concept, however, may be embodied in various different forms, and should not be construed as being limited only to the illustrated embodiments. Unless otherwise noted, like reference numerals may denote like elements throughout the attached drawings and written description, and thus descriptions will not be repeated. In the drawings, the sizes and relative sizes of layers and regions may be exaggerated for clarity.

It will be understood that when an element or layer is referred to as being "on", "connected to", "coupled to", or "adjacent to" another element or layer, it can be directly on, connected, coupled, or adjacent to the other element or layer, or intervening elements or layers may be present.

FIG. 1 is a block diagram that schematically illustrates a liquid crystal display device according to an embodiment of the inventive concept.

As shown in FIG. 1, a liquid crystal display device 1000 according to an embodiment of the inventive concept includes a liquid crystal panel 100, a timing controller 200, a gate driver 300, and a data driver 400.

In the liquid crystal panel 100, a plurality of gate lines G1 to Gm extend in a first direction DR1, and a plurality of data lines D1 to Dn extend in a second direction DR2 crossing the first direction DR1. Pixel areas may be defined by the gate lines G1 to Gm and the data lines D1 to Dn. Pixels PX that display an image are provided in the pixel areas, respectively. In FIG. 1, there is shown a pixel PX that is connected to a first gate line G1 and a first data line D1.

The timing controller 200 receives image data RGB and a control signal from an external graphics control unit. The control signal may contain a vertical synchronization signal, hereinafter referred to as the Vsync signal, that separates frames, a horizontal synchronization signal, hereinafter referred to as the Hsync signal, that separates rows, a data enable signal, hereinafter referred to as the DE signal, that is high only during an interval in which data is output to indicate a data-in interval, and a main clock signal MCLK.

The timing controller 200 converts the image data RGB into a form suitable for the data driver 400 and outputs the converted data to the data driver 400. The timing controller 200 generates a gate control signal GS1 and a data control signal DS1. The timing controller 200 outputs the gate control signal GS1 to the gate driver 300 and the data control signal DS1 to the data driver 400. The gate control signal GS1 controls the gate driver 300, and the data control signal DS1 controls the data driver 400.

The timing controller 200 analyzes the image data RGB frame by frame. The timing controller 200 may apply inversion driving to the frame data N times, where N is an integer of 2 or more. This will be more fully described below.

The gate driver 300 generates a gate signal based on the gate control signal GS1 and outputs it to the gate lines G1 to Gm.

The data driver 400 converts the image data RGB based on the data control signal DS1 and outputs resultant data to the data lines D1 to Dn.

Figure 2:
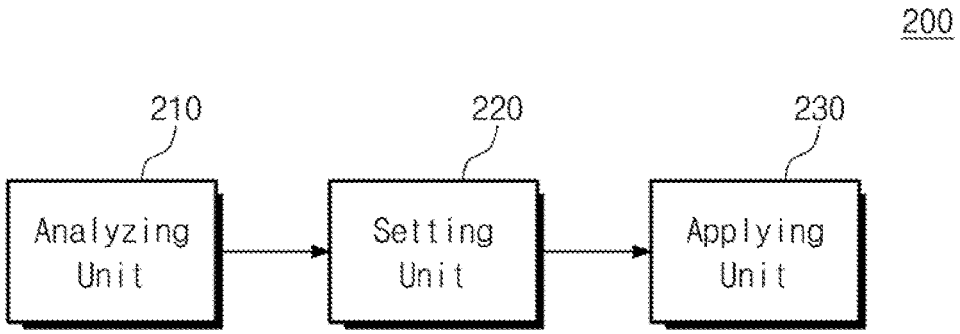
FIG. 2 is a block diagram that schematically illustrates a timing controller shown in FIG. 1.

FIG. 2 is a block diagram that schematically illustrates a timing controller shown in FIG. 1.

Referring to FIGS. 1 and 2, a timing controller 200 incorporates an analyzing unit 210, a setting unit 220, and an applying unit 230.

The analyzing unit 210 analyzes frame data line by line.

The setting unit 220 sets a plurality of data areas that match a PDF target pattern. The PDF target pattern includes a variety of patterns to which inversion driving is to be applied.

The setting unit 220 may set data areas using line data having the same PDF target pattern as a boundary.

In exemplary embodiments, the setting unit 220 determines a pattern type of the line data. If a pattern type of line data does not change and the number of line data that matches the PDF target pattern and a line data type are first recognized, the setting unit 220 stores a start point of the data area. If a pattern type of the line data change and the number of line data that matches the PDF target pattern is greater than a first setting value and the number of data areas set is less than a second setting value, the setting unit 220 stores an end point of the data area and a type of the PDF target pattern of the data area. The setting unit 220 determines whether the line data is the last line data of the frame data. If the number of line data matched with the PDF target pattern is greater than a third setting value and the number of data areas set is less than the second setting value, the setting unit 220 stores an end point of the last data area and a type of the PDF target pattern of the last data area.

In other exemplary embodiments, the setting unit 220 may set data areas using pattern data of line data having the same PDF target pattern as a boundary. The line data may be formed of segments of the respective line data. That is, in other exemplary embodiments, the data areas may be partitioned using a vertical line as well as a horizontal line as a boundary. The setting unit 220 determines whether a pattern type of the line data changes. If a pattern type of the line data does not change and the line data matches the PDF target pattern and a pattern in the line data is first recognized, the setting unit 220 stores first-direction and second-direction location information of a start point of a data area. If a pattern type of line data changes and the number of line data that match the PDF target pattern is greater than the first setting value and the number of data areas set is less than the second setting value, the setting unit 220 stores first-direction and second-direction location information of an end point of the data area. The setting unit 220 determines whether the line data is the last line data of the frame data. If the number of line data matched with the PDF target pattern is greater than the third setting value and the number of data areas set is less than the second setting value, the setting unit 220 stores the first-direction and second-direction location information of an end point of the last data area and a type of the PDF target pattern of the last data area.

In still other exemplary embodiments, the setting unit 220 determines whether a pattern type of the line data changes. If a pattern type of the line data does not change and the line data matches the PDF target pattern and a pattern of the line data is first recognized, the setting unit 220 stores first-direction and second-direction location information of each of the start and end points of a data area. If the number of line data that matches the PDF target pattern is greater than the first setting value and the number of data areas set is less than the second setting value, the setting unit 220 stores the first-direction and second-direction location information of an end point of the data area and a type of the PDF target pattern of the data area.

In still other exemplary embodiments, the setting unit 220 may store the line data as a target to which PDF may or may not be applied.

The applying unit 230 may independently apply inversion driving to the data areas. At this time, the applying unit 230 may determine whether to apply the inversion driving to each data area and may apply different inversion driving techniques to the data areas.

Below, referring to FIGS. 3 and 4, will be described a method of dividing a frame of image data into a plurality of data areas and independently applying inversion driving to each data area.

Figure 3A:
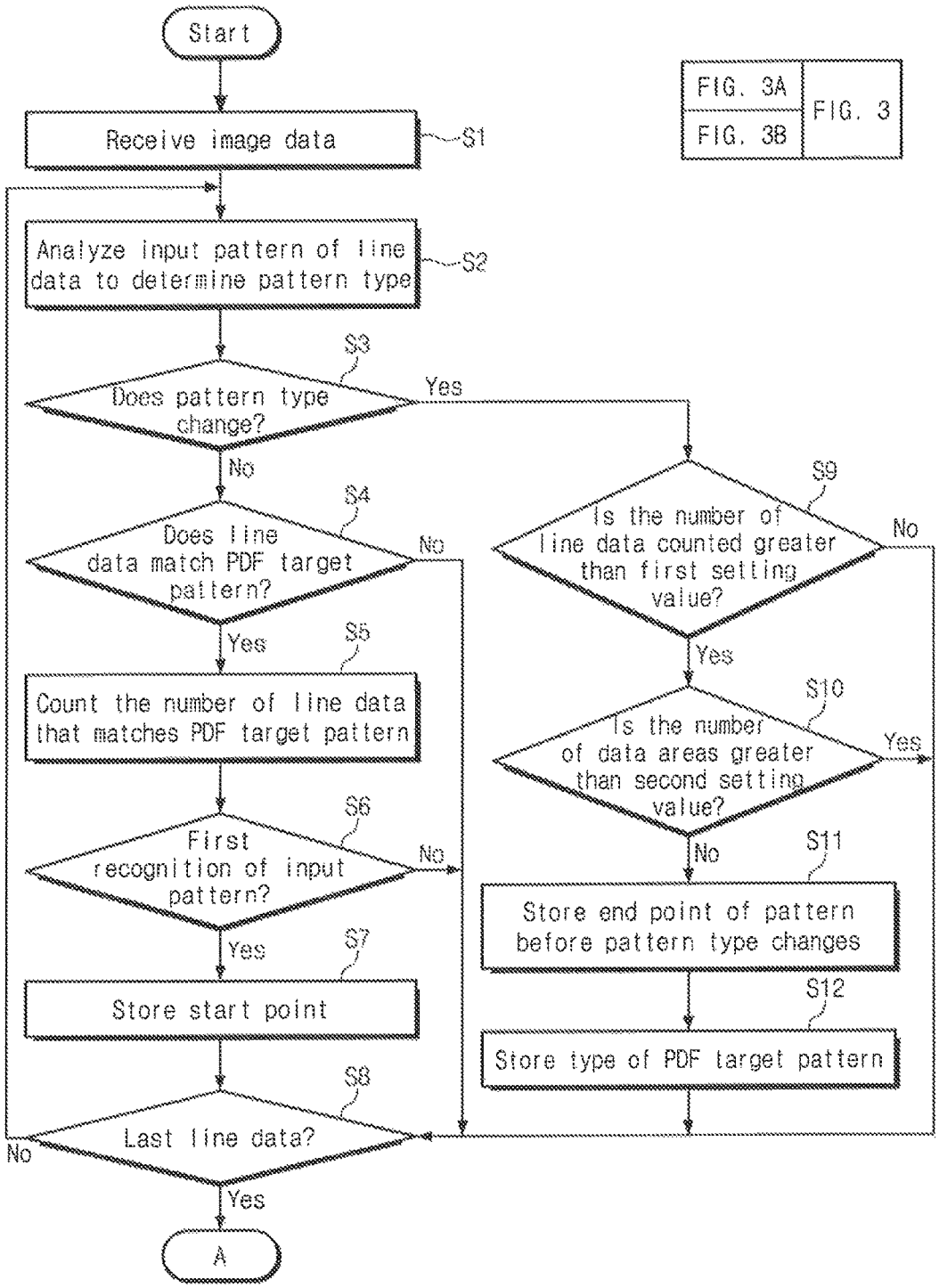
FIGS. 3A-B is a flow chart that schematically illustrates a method of changing inversion driving according to an embodiment of the inventive concept.
Figure 3B:
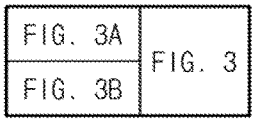
Figure 3B:
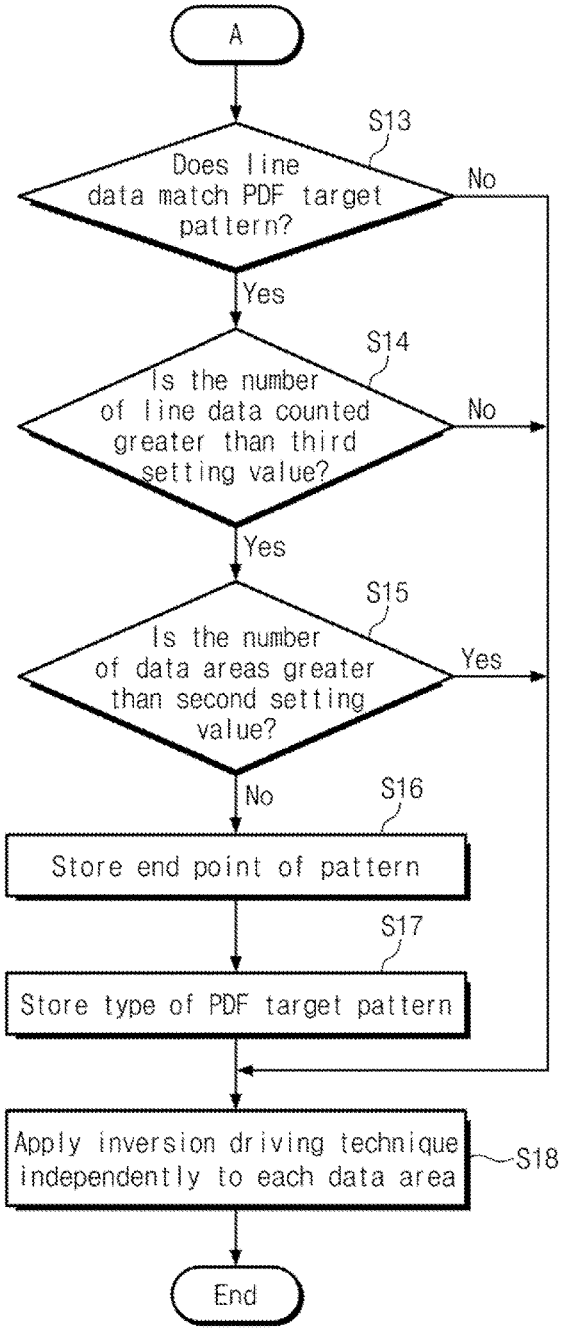

FIGS. 3A-B is a flow chart that schematically illustrates a method of changing inversion driving according to an embodiment of the inventive concept. FIG. 4 is a conceptual diagram that shows an image on which frame data that is divided into areas is displayed.

Figure 4:
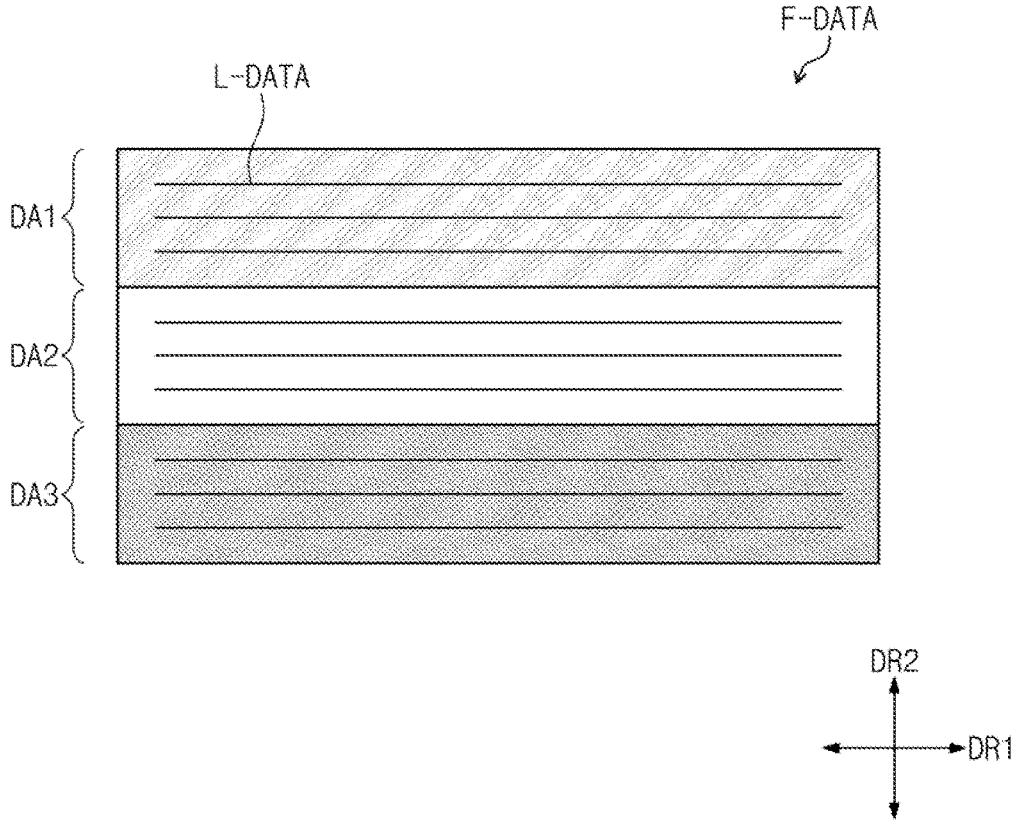
FIG. 4 is a conceptual diagram that shows an image on which frame data is divided into areas is displayed.

Referring to FIGS. 3A-B and 4, in step S1, a frame of image data is received. Below, a frame of image data may be referred to as frame data F-DATA. The frame data F-DATA includes a plurality of line data L-DATA. The line data L-DATA may be data that is to be applied to pixels connected by a gate line.

In step S2, a pattern type is determined by analyzing an input pattern of the line data L-DATA. In step S3, it is determined whether a pattern type of ith line data, where i is a natural number, changes. This may accomplished by comparing a pattern type of an i-th line data with that of (i−1)th line data. First line data may be determined as a pattern type that is unchanged, since the object to be compared with the first line data does not exist.

If a pattern type does not change, it is determined in step S4 whether the ith line data matches with a PDF target pattern. The PDF target pattern may be a pattern of the object to be inversely driven and may include a plurality of patterns. If the ith line data is determined as matching the PDF target pattern, the number of line data following the ith line data that match the PDF target pattern is counted in step S5. If the ith line data is determined as not matching the PDF target pattern, it is determined in step S8 whether the ith line data is the last line data of the frame data F-DATA.

In step S6, it is determined whether the ith line data is line data of an input pattern that has been first recognized in the continuous line data with the same PDF target pattern. If so, in step S7, the ith line data is stored as a start point of a data area. If not, the method proceeds to step S8 in which it is determined whether the ith line data is the last line data of the frame data F-DATA.

Returning to step S3, if a pattern type of the ith line data is determined as changing, it is determined in step S9 whether the number of line data following the ith line data matched with the PDF target pattern is greater than a first setting value. The first setting value may be a reference for determining whether to set a separate data block for changing an inversion technique. The smaller the first setting value, the greater the number of data areas obtained from the frame data F-DATA. An inversion driving technique may change under this condition, but the size of memory needed to store the data areas increases. If the number of line data that follow the ith line data matched with the PDF target pattern is less than the first setting value, the method proceeds to step S8.

If the number of line data that follow the ith line data matched with the PDF target pattern is greater than the first setting value, the method proceeds to step S10, in which it is determined whether the number of data areas currently stored is greater than a second setting value. Since the size of memory for storing data areas increases as the number of data areas increases, it is determined whether to set additional data areas based on the second setting value. If the number of data areas is greater than the second setting value, the method proceeds to step S8 without setting a data area. If the number of data areas is less than the second setting value, in which case there remains memory for storing data areas, the method proceeds to step S11, in which the (i−1)-th line data before the pattern type change is stored as an end point of a data area. In step S12, the type of the PDF target pattern of the data area between the start point and the end point is stored.

Returning to step S8, if the ith line data is the last line data of the frame data F-DATA, the method proceeds in step S13, in which it is determined whether the ith line data matches with the PDF target pattern. If it is determined that the ith line data is the last line data, steps S13 to S16 are performed to determine whether to set the last data block, since the setting of a data block must be terminated regardless of whether a pattern type changes. If it is determined that the ith line data is the last line data of the frame data F-DATA, the method proceeds to step S2 to set a new data area.

Returning to step S13, if the ith line data matches the PDF target pattern, the method proceeds to step S14, in which it is determined whether number of line data following the ith line data that match the PDF target pattern is greater than a third setting value. The third setting value may be a reference that is used to determine whether to set the last data block for changing an inversion technique. The third setting value may be equal to the first setting value. If it is determined that number of line data following the ith line data that match the PDF target pattern is less than the third setting value, the method proceeds to step S18 to terminate the setting of a data area.

If it is determined that number of line data following the ith line data that match the PDF target pattern is greater than the third setting value, in step S14, it is determined whether the number of data areas currently stored is greater than a second setting value. If the number of data areas currently stored is greater than the second setting value, the method proceeds to step S18 to terminate the setting of a data area.

If it is determined that the number of data areas currently stored is less than the second setting value, i.e. memory remains to store data areas, the ith line data is stored in step S16 as an end point of the last data area. In step S17, the type of the PDF target pattern of the last data area is stored. In step S18, an inversion driving technique is independently applied every data area. According to an embodiment of the inventive concept, it is possible to apply a different inversion driving technique to each data area as well as to determine whether to apply an inversion driving technique independently to each data area.

In FIG. 4, the frame data F-DATA is illustrated as being divided into three data areas DA1 to DA3. Each data area DA1 to DA3 may include a plurality of line data L-DATA. In FIG. 4, each data area DA1 to DA3 is illustrated as including three line data L-DATA. Different inversion driving techniques may be applied to the data areas DA1 to DA3. Also, an inversion driving technique may be applied to some but not all of the data areas DA1 to DA3.

Figure 5:
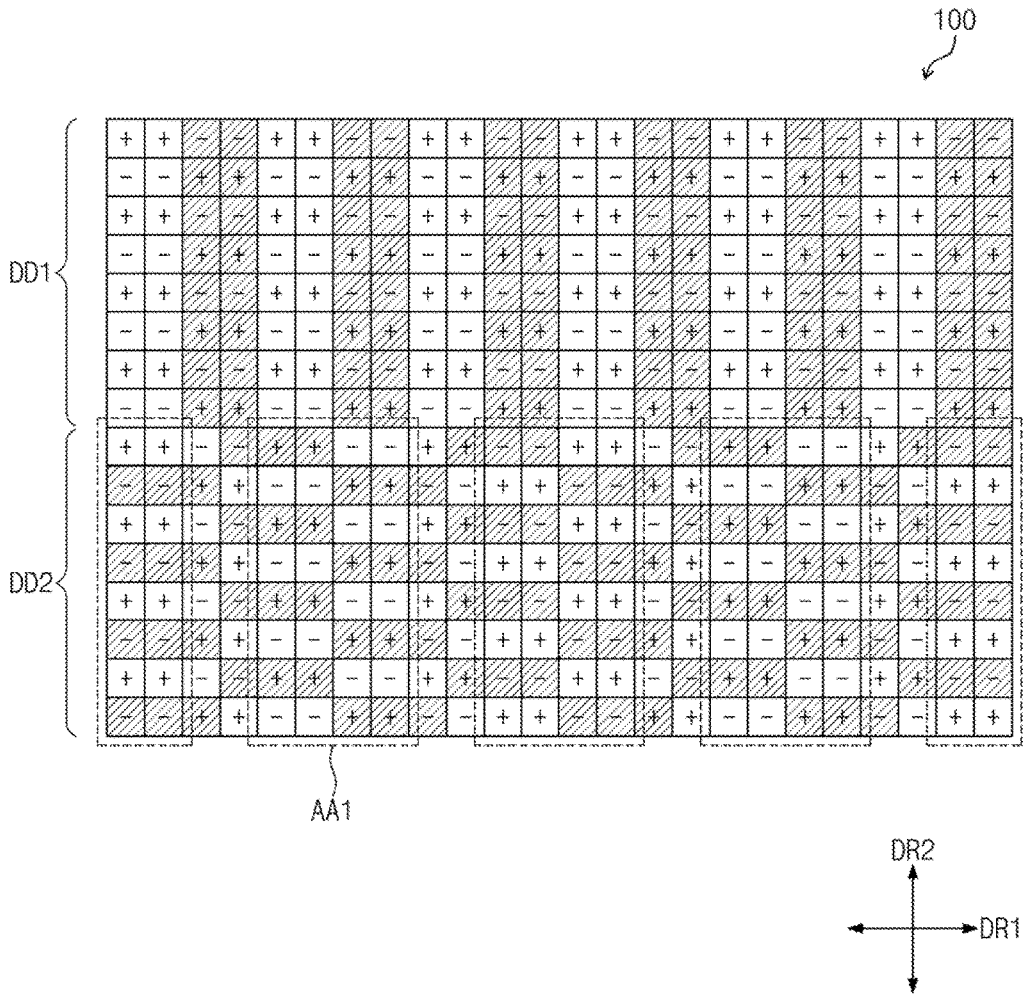
FIG. 5 is a diagram that schematically illustrates an image that is displayed when a first inversion technique is applied to specific frame data.
Figure 6:
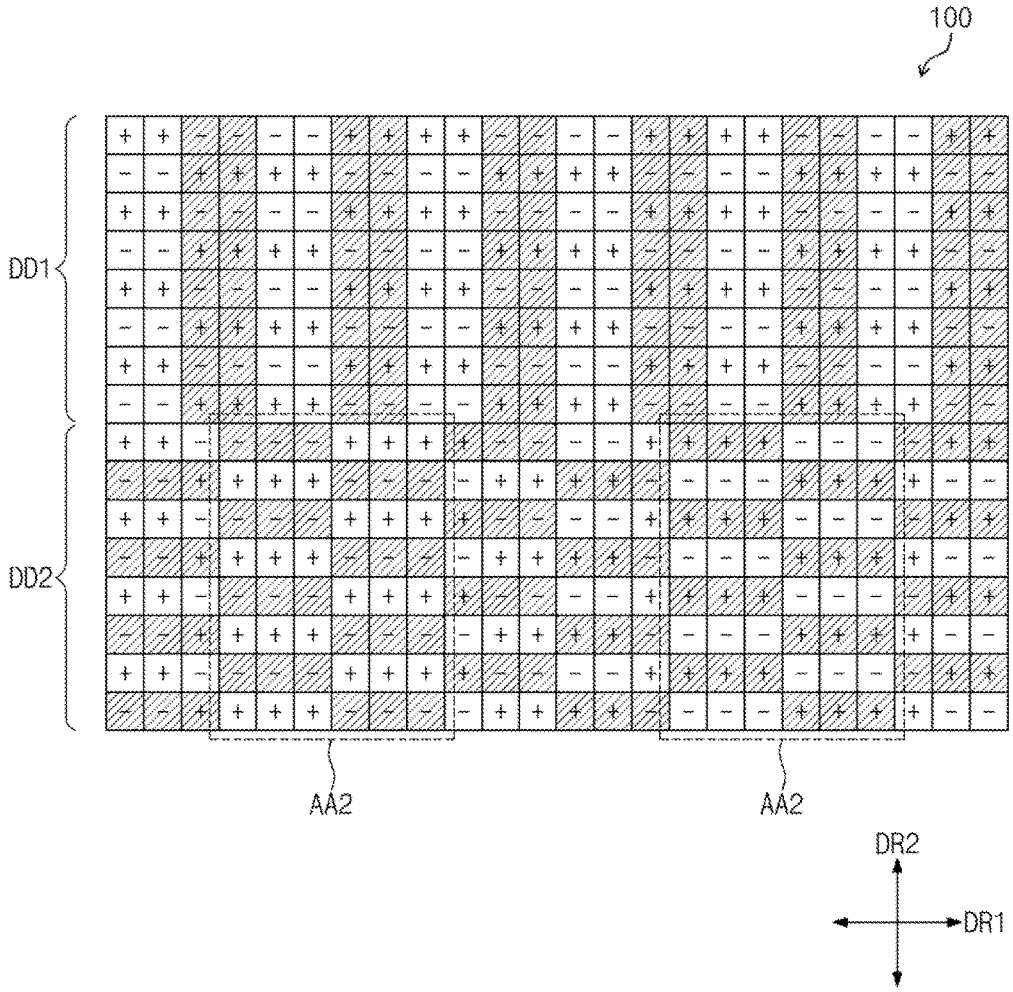
FIG. 6 is a diagram that schematically illustrates an image that is displayed when a second inversion technique is applied to the same frame data as shown in FIG. 5.

FIG. 5 is a diagram that schematically illustrates an image that is displayed when a first inversion technique is applied to specific frame data. FIG. 6 is a diagram that schematically illustrates an image that is displayed when a second inversion technique is applied to the same frame data as shown in FIG. 5.

In FIGS. 5 and 6, frame data is illustrated as being displayed on a 24×16 pixel part of a liquid crystal panel 100. In FIGS. 5 and 6, a sign "+" indicates that a polarity of a data voltage applied to a pixel is positive, and a sign "−" indicates that a polarity of a data voltage applied to a pixel is negative. A hatched box indicates a pixel to which a data voltage with "0" gray scale (black), hereinafter referred to as off data, is applied, and a white box indicates a pixel to which a data voltage with a gray scales other than "0", hereinafter referred to as on data, is applied.

The frame data has a first data area DD1 and a second data area DD2. In the first data area DD1, the on data and off data are alternately displayed in a first direction DR1 with the on data and off data each displayed on two pixels. Also, in the first data area DD1, on data or off data is continuously displayed in a second direction DR2. In the second data area DD2, the on data and off data are alternately displayed in the first direction DR1 with the on data and off data each displayed on three pixels. Also, in the second data area DD2, the on data and off data are alternately displayed in the second direction DR2 with the on data and off data each displayed on one pixel.

Below, data applied to a row of pixels adjacent in the first direction DR1 may be referred to as horizontal line data.

Referring to FIG. 5, a first inversion technique is a technique in which a polarity of a data voltage is inverted every two pixels in the first direction DR1, which is the direction along which gate lines extend, but it is inverted every pixel in the second direction DR2, which is the direction along which data lines extend.

In the first data area DD1, all on data included in the horizontal line data may have the same polarity ("+" or "−"). Horizontal line data, such as first line data, with "+" polarity on-data may shift a common voltage in a positive-polarity direction, and horizontal line data, such as second line data, with "−" polarity on-data may be shift the common voltage in a negative-polarity direction. In this case, a horizontal line is seen every pixel row, and crosstalk may occur between outer data and the first data area DD1 when the outer data exists outside of the first data area DD1.

In the second data area DD2, a ratio of positive polarities to negative polarities of on data in the horizontal line data is equal to one. However, only on data having the same polarity may be displayed in a part AA1 of the second data area DD2, which appears as a horizontal line every other pixel line.

Referring to FIG. 6, it may be assumed that an inversion technique of the first and second data areas DD1 and DD2 has changed from a first inversion technique to a second inversion technique.

The second inversion technique is a technique in which polarities of the $5^{th}$ and $6^{th}$ dots and polarities of the $7^{th}$ and $8^{th}$ dots are switched on the basis of eight dots in a first direction DR1. For example, a first dot row has polarities of "++−−++−−" according to the first inversion technique, but it has polarities of "++−−−−++" according to the second inversion technique.

A ratio of positive polarities to negative polarities of on data included in horizontal line data may be equal to one by applying the second inversion technique to the first data area DD1. Thus, it is possible to correct the voltage shift, described with reference to FIG. 5, that occurs in the first data area DD1 when the first inversion technique is applied.

In the second data area DD2, the number of on data having the same polarity in an area AA2 increases as compared with FIG. 5 where the first inversion technique is used. This means that a horizontal line may be more clearly seen in plural pixel rows as compared with FIG. 5.

The voltage shift described with reference to FIGS. 5 and 6 may occur when the same inversion technique is applied to one frame data. According to an embodiment of the inventive concept, one frame data may be divided into a plurality of data areas and independent inversion driving techniques may be applied to each of the data areas. Thus, a horizontal line, a vertical line, and crosstalk may not appear although an image is displayed that includes the first and second data areas DD1 and DD2 in a frame.

Figure 7:
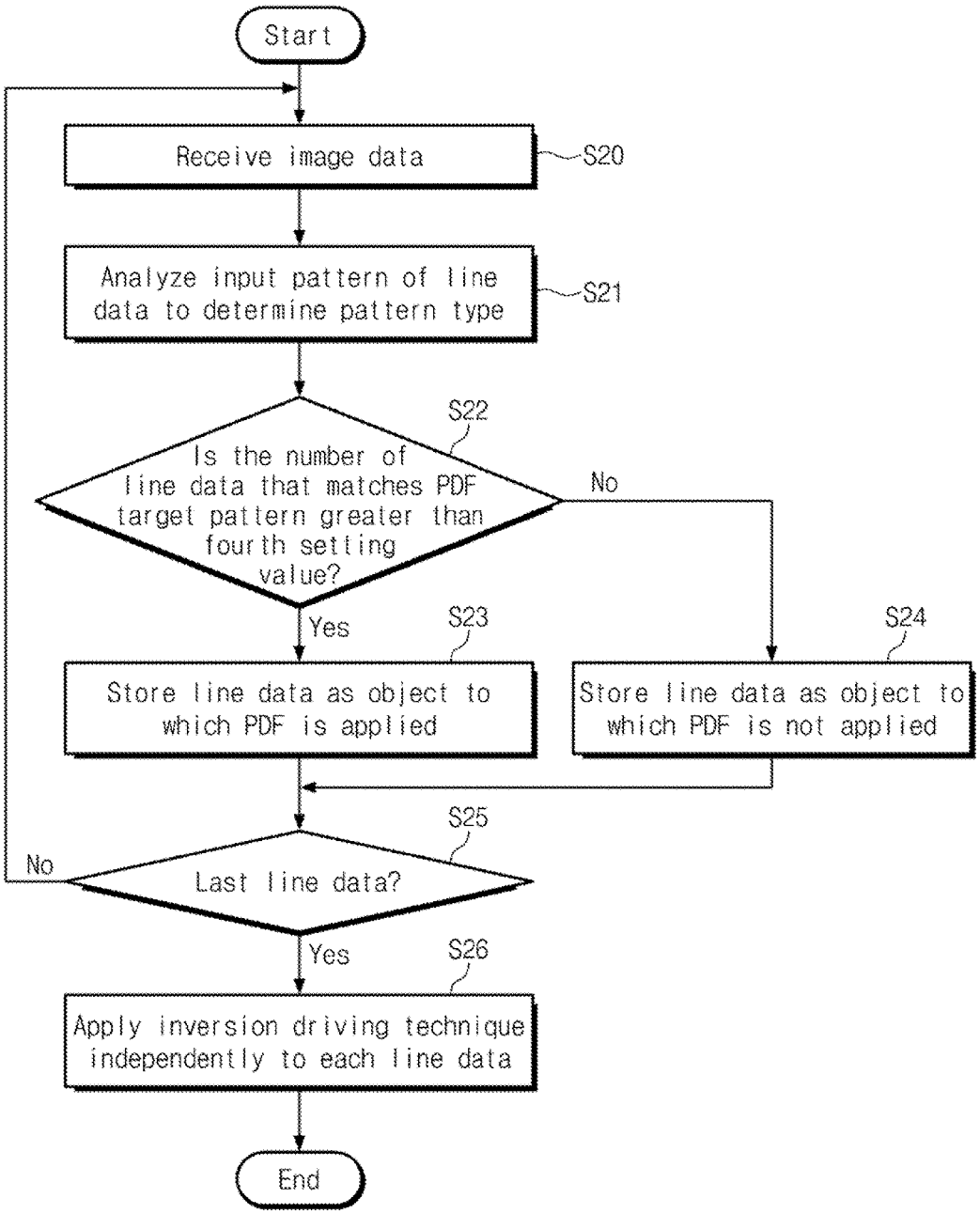
FIG. 7 is a flow chart that schematically illustrates a method of changing an inversion driving technique, according to another embodiment of the inventive concept.

Referring to FIG. 7, a method of applying an inversion driving technique independently to each line data of a frame of image data will be described.

FIG. 7 is a flow chart that schematically illustrates a method of changing an inversion driving technique, according to another embodiment of the inventive concept.

Referring to FIG. 7, in step S20, a frame of image data is received. Below, a frame of image data is referred to as frame data. The frame data includes a plurality of line data to be applied to pixels connected to a gate line.

In step S21, the number of data that matches a PDF target pattern is determined by analyzing an input pattern of the line data. In step S22, it is determined whether the number of data from ith line data, where i is a natural number, that matches the PDF target pattern is greater than a fourth setting value. The fourth setting value may be a reference that is used to determine whether to apply an inversion driving technique to the ith line data.

In step S23, the ith line data is stored as a PDF target when the number of data from ith line data that matches the PDF target pattern, is greater than the fourth setting value. In step S23, the line data may be stored with a pattern type of the line data as well as information indicating that it is the PDF target. If the number of data from ith line data that matches the PDF target pattern is smaller than the fourth setting value, the ith line data is stored in step S24 as an object to which PDF is not applied.

In step S25, it is determined whether the ith line data is the last line data of the frame data. If not, the method proceeds to step S21. If so, the method proceeds to step S26. In step S26, an inversion driving technique is applied every line data, based on information stored with every line data that indicates whether PDF is to be applied.

With the method described with reference to FIG. 7, it is possible to determine whether to apply PDF every line data. Thus, defects that may occur when an image with various patterns is displayed, such as a horizontal line, a vertical line, and crosstalk, may be eliminated.

Figures 8, 8A, 8B:
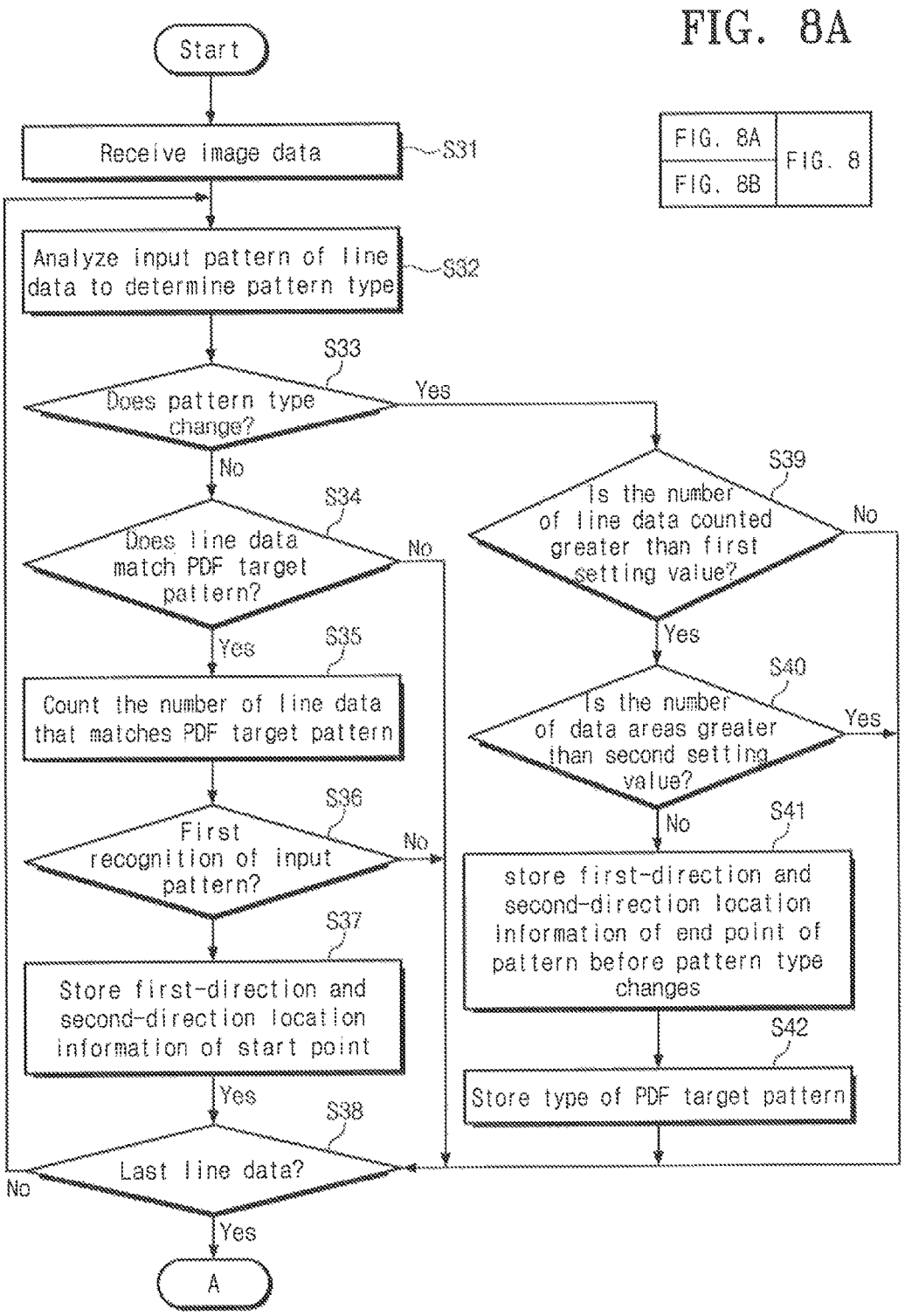
FIGS. 8A-B is a flow chart that schematically illustrates a method of changing inversion driving according to another embodiment of the inventive concept.
Figure 8B:
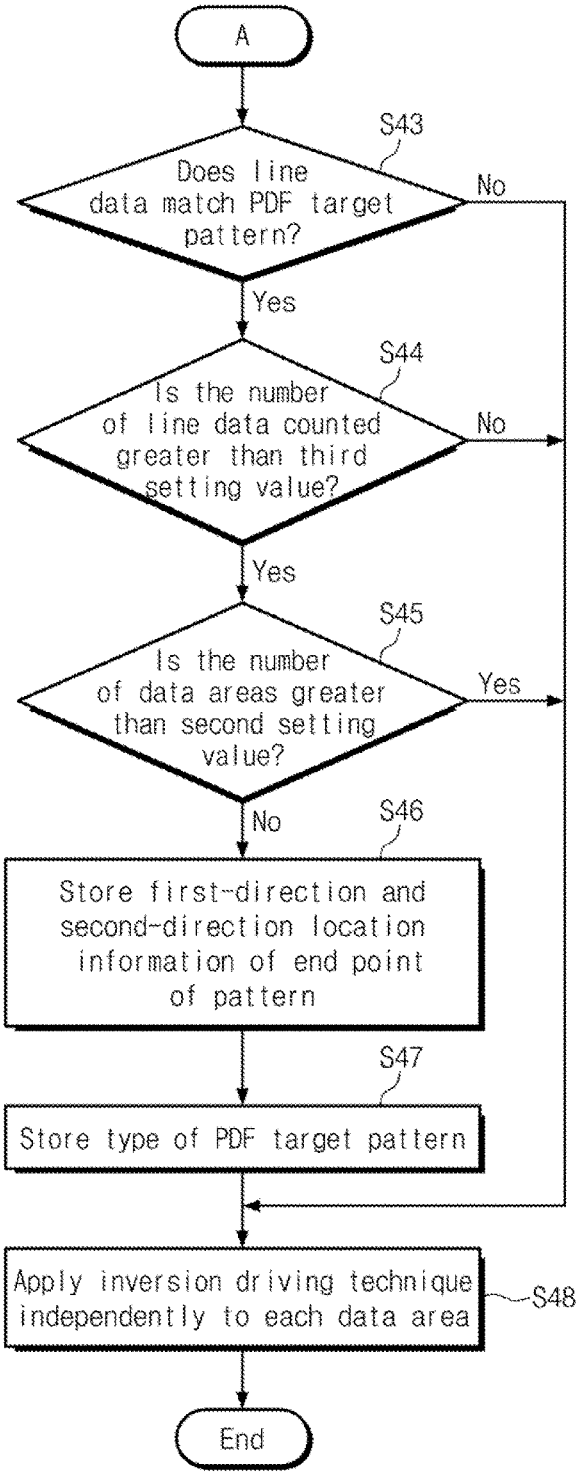
Figure 9:
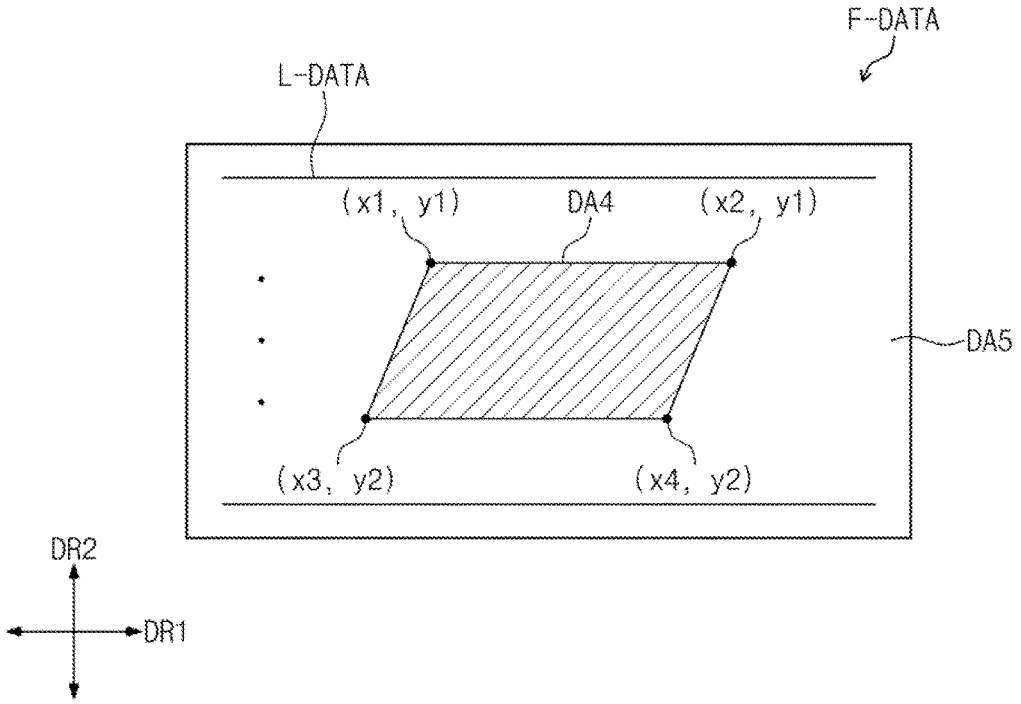
FIG. 9 is a conceptual diagram that shows an image on which frame data that is divided into areas is displayed.

FIGS. 8A-B is a flow chart that schematically illustrates a method of changing inversion driving according to another embodiment of the inventive concept. FIG. 9 is a conceptual diagram that shows an image on which frame data that is divided into areas is displayed.

Referring to FIGS. 8A-B and 9, in step S31, a frame of image data is received. Below, a frame of image data may be referred to as frame data F-DATA. The frame data F-DATA includes a plurality of line data L-DATA. The line data L-DATA may be applied to pixels connected with a gate line.

In step S32, a type of a pattern is determined by analyzing an input pattern of the line data L-DATA. In step S33, it is determined whether a pattern type of ith line data, where i is a natural number, has changed. This may accomplished by comparing a pattern type of an ith line data with that of (i−1)th line data. First line data may be determined to be an unchanged pattern type, since the object to be compared with does not exist.

If a pattern type is determined as being unchanged, it is determined in step S34 whether the ith line data matches a PDF target pattern. The PDF target pattern may be an object pattern to be inversely driven and may include a plurality of patterns. If the ith line data is determined as being matched with the PDF target pattern, then, in step S35, the number of line data following the ith line data that match the PDF target pattern is counted. If the ith line data is determined as not matching the PDF target pattern, the method proceeds to step S38, in which it is determined whether the ith line data is the last line data of the frame data F-DATA.

In step S36, it is determined whether an input pattern of the ith line data is first recognized as the same PDF target pattern. If so, in step S37, first-direction and second-direction location information of an input pattern of the ith line data is stored as a start point of a data area. In FIG. 9, first-direction and second-direction location information (x1, y1) and (x2, y1) of an input pattern first recognized as matching the PDF target pattern is stored as a start point of a data area DA4.

If it is determined that an input pattern of the ith line data is not line data that is first recognized as the same PDF target pattern, the method proceeds to step S38 in which it is determined whether the ith line data is the last line data of the frame data F-DATA.

Returning to step S33, if a pattern type of the ith line data is determined as having changed, then it is determined in step S39 whether the number of line data following the ith line data that match the PDF target pattern is greater than a first setting value. The first setting value may be a reference for determining whether to set a separate data block for changing an inversion technique. The smaller the first setting value, the greater the number of data areas that may be obtained from the frame data F-DATA. An inversion driving technique may change under this condition, but the size of memory needed to store the data areas increases. If the number of line data following the ith line data that match the PDF target pattern is less than the first setting value, the method proceeds to step S38.

If the number of line data following the ith line data that match the PDF target pattern is greater than the first setting value, the method proceeds to step S40, in which it is determined whether the number of data areas currently stored is greater than a second setting value. Since the size of memory for storing data areas increases as the number of data areas increases, whether to set additional data areas may be determined based on the second setting value. If the number of data areas is greater than the second setting value, the method proceeds to step S38 without setting a data area. If the number of data areas is less than the second setting value, in which case there remains memory for storing data areas, the method proceeds to step S41, in which first-direction and second-direction location information of an input pattern of the (i−1)th line data before a pattern type changes is stored as an end point of a data area. In FIG. 9, first-direction and second-direction location information (x3, y2) and (x4, y2) of an input pattern last recognized may be stored as an end point of a data area DA4 that matches the PDF target pattern.

In step S42, the PDF target pattern type of the data area between the start point and the end point is stored.

If it is determined that the ith line data is the last line data, steps S43 to S46 for determining whether to set the last data block are performed, since the setting of a data block must be terminated regardless of whether a pattern type changes. Returning to step S38, if the ith line data is the last line data of the frame data F-DATA, the method proceeds in step S43, in which it is determined whether the ith line data matches the PDF target pattern. If it is determined that the ith line data is not the last line data of the frame data F-DATA, the method proceeds to step S32 to set a new data area.

Returning to step S43, if the ith line data matches the PDF target pattern, the method proceeds to step S44, in which it is determined whether the number of line data following the ith line data that matches the PDF target pattern is greater than a third setting value. The third setting value may be a reference that is used to determine whether to set the last data block for changing an inversion technique. The third setting value may be equal to the first setting value. If it is determined that number of line data following the ith line data that matches the PDF target pattern is less than the third setting value, the method proceeds to step S48 to terminate the setting of a data area.

If it is determined in step S44 that number of line data following the ith line data that matches the PDF target pattern is greater than the third setting value, then it is determined in step S45 whether the number of data areas currently stored is greater than a second setting value. If the number of data areas currently stored is greater than the second setting value, the method proceeds to step S48 to terminate the setting of a data area.

If it is determined that the number of data areas currently stored is less than a second setting value, in which case there remains memory for storing data areas, then, in step S46, first-direction and second-direction location information of the ith line data is stored as an end point of the last data area. In step S47, a type of the PDF target pattern having the last data area is stored. In step S48, an inversion driving technique is independently applied to each data area. According to an embodiment of the inventive concept, it is possible to apply a different inversion driving technique to each data area as well as to determine whether to apply an inversion driving technique independently to each data area.

In FIG. 9, the frame data F-DATA is illustrated as being divided into two data areas DA4 and DA5. Different inversion driving techniques may be applied to the data areas DA4 and DA5. In addition, an inversion driving technique may be applied to one, but not both of the data areas DA4 and DA5. The data area DA4 may be an area where first-direction (DR1) and second-direction (DR2) location information of the start point and first-direction and second-direction location information of the end point are linked.

Figure 10A:
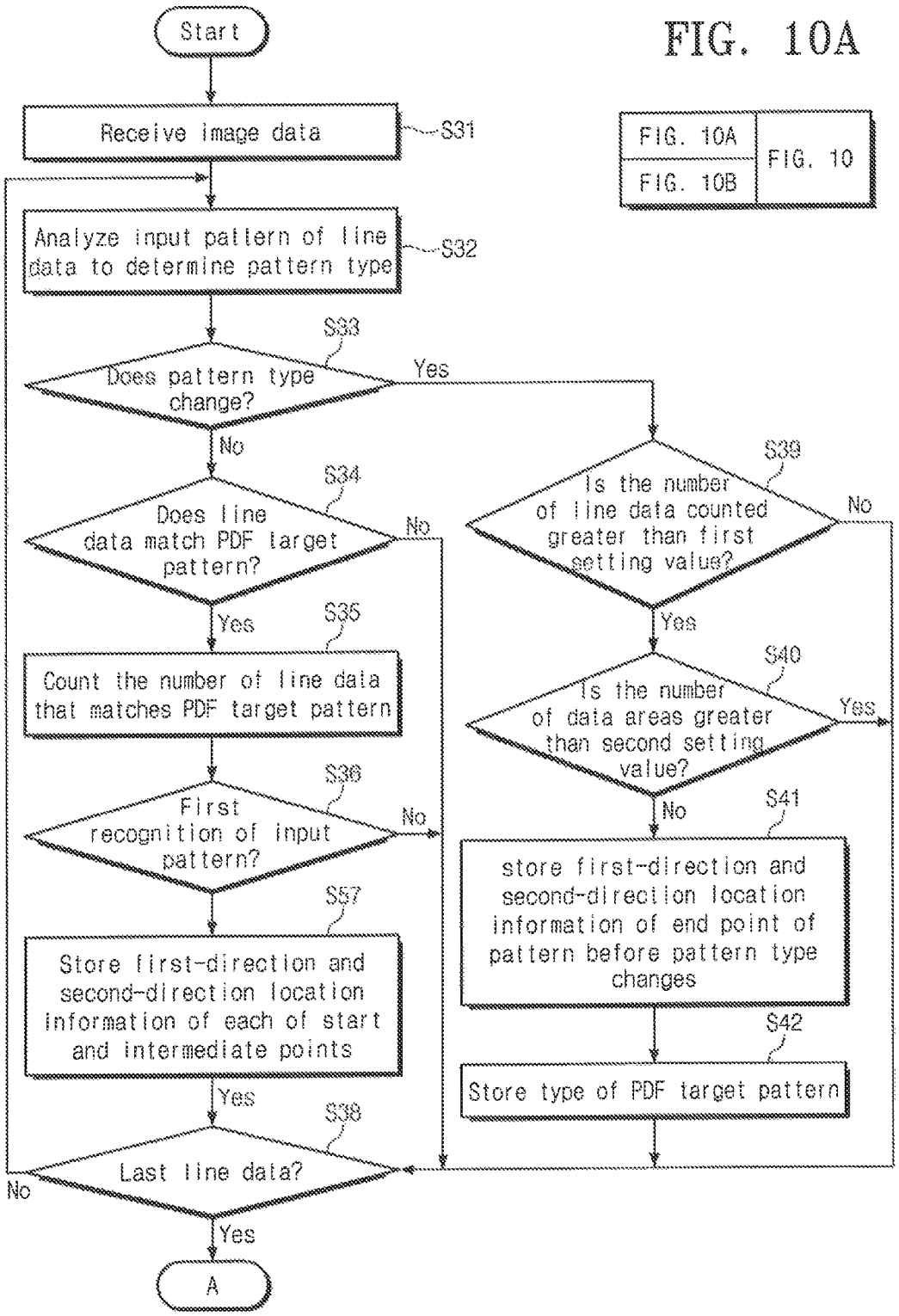
FIGS. 10A-B is a flow chart that schematically illustrates a method of changing inversion driving according to still another embodiment of the inventive concept.
Figure 10B:
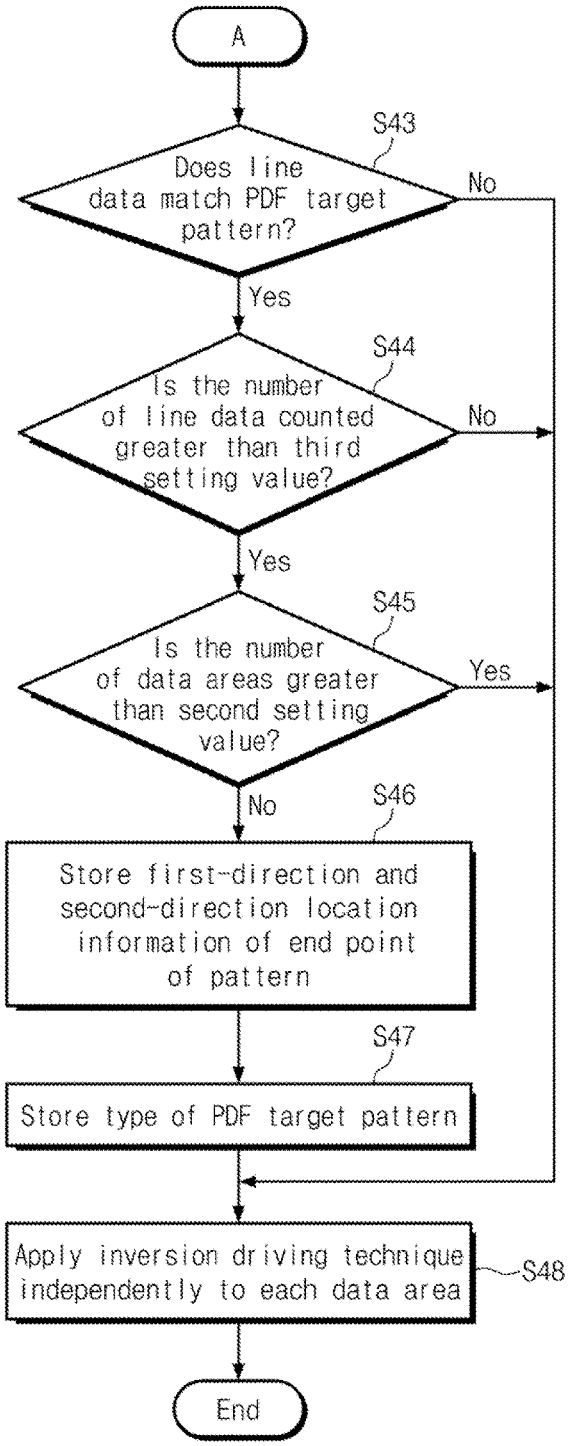
Figure 10B:
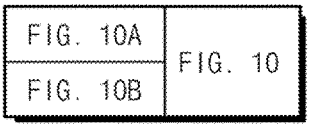
Figure 11:
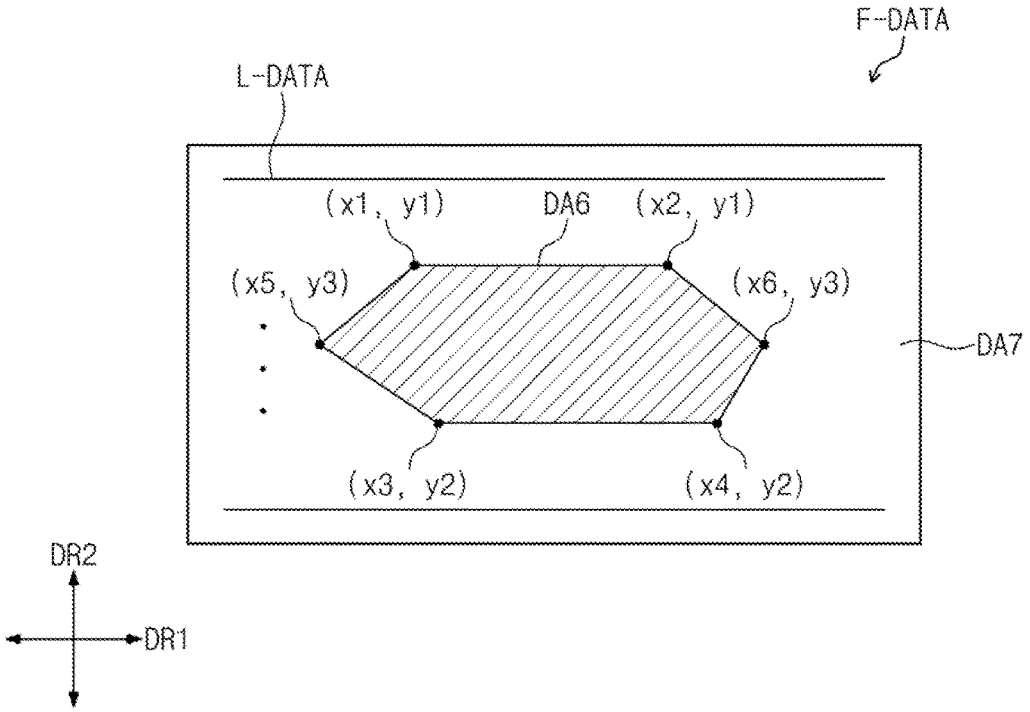
FIG. 11 is a conceptual diagram that shows an image on which frame data that is divided into areas is displayed.

FIGS. 10A-B is a flow chart that schematically illustrates a method of changing inversion driving according to still another embodiment of the inventive concept. FIG. 11 is a conceptual diagram that shows an image on which frame data that is divided into areas is displayed.

A method shown in FIGS. 10A-B is substantially the same as that shown in FIGS. 8A-B, except for step S57, and a repeated description thereof is thus omitted. Below, an operation associated with step S57 will be more fully described with reference to FIGS. 10A-B.

Referring to step S36, if an input pattern of ith line data is line data that is first recognized as having the same PDF target pattern, the method proceeds to step S57, in which first-direction and second-direction location information of an input pattern of the ith line data may be stored as a start point of a data area and first-direction and second-direction location information of an intermediate point may be stored. There may be a plurality of intermediate points. As the number of intermediate points increases, it is possible to set a data area to which the PDF is to be applied to approximate an input pattern.

In case there is one intermediate point, second-direction location information of the intermediate point may be obtained by adding half the number of line data counted in step S35 to second-direction location information of a start point. In FIG. 11, first-direction (DR1) and second-direction (DR2) location information (x1, y1) and (x2, y1) of an input pattern first recognized to set a data area DA6 matched with a PDF target pattern may be stored as a start point of a data area. In addition, line data may be selected as an intermediate point based on the number of line data matched with the PDF target pattern and the second-direction (DR2) location information of the start point, and first-direction (DR1) and second-direction (DR2) location information (x5, y3) and (x6, y3) of the intermediate points may be stored.

In FIG. 11, the frame data F-DATA is illustrated as being divided into two data areas DA6 and DA7. Different inversion driving techniques may be applied to the data areas DA6 and DA7. In addition, an inversion driving technique may be applied to one but not both of the data areas DA6 and DA7. The data area DA6 may be an area where first-direction (DR1) and second-direction (DR2) location information of the start point, first-direction and second-direction location information of the intermediate points, and first-direction and second-direction location information of the end point are linked.

While embodiments of the inventive concept have been described with reference to exemplary embodiments, it will be apparent to those skilled in the art that various changes and modifications may be made without departing from the spirit and scope of the present inventive concept. Therefore, it should be understood that the above embodiments are not limiting, but illustrative.

What is claimed is:

1. A liquid crystal display device comprising:

a liquid crystal panel that includes gate lines, data lines crossing the gate lines, and pixels connected to the gate lines and the data lines; and a timing controller configured to receive a control signal and image data and to generate a gate control signal and a data control signal and to analyze the image data frame by frame and to apply two or more inversion driving techniques to frame data which is a frame of the image data, wherein the timing controller comprises:

an analyzing unit configured to analyze the frame data line by line to determine pattern types;

a setting unit configured to set a plurality of data areas using data that match a pattern detect function (PDF) target pattern as a boundary; and an applying unit configured to apply two or more different inversion driving techniques independently to each data area with different patterns.

2. The liquid crystal display device of claim 1, further comprising:

a gate driver configured to generate a gate signal based on the gate control signal and to output the gate signal to the gate lines; and a data driver configured to perform data conversion on the image data based on the data control signal and to output a conversion result to the data lines.

3. The liquid crystal display device of claim 1, wherein the data is line data.

4. The liquid crystal display device of claim 1, wherein the data is pattern data.

5. A method of driving a liquid crystal display device, comprising:

analyzing input frame data, which is a frame of image data, to determine a pattern type of line data;

setting a plurality of data areas that match a pattern detect function (PDF) target pattern; and applying two or more different inversion driving techniques independently to each data area with different patterns, wherein setting a plurality of data areas that match a PDF target pattern comprises:

determining whether a pattern type of the line data has changed with respect to previous line data;

storing first information of a start point of a data area if: the pattern type of the line data has not changed, the line data matches the PDF target pattern, and a pattern of the line data is first recognized; and storing second information of a type of the PDF target pattern of the data area and an end point of the data area if: the pattern type of the line data has changed, a number of line data that matches the PDF target pattern is greater than a first setting value, and a number of data areas set is less than a second setting value.

6. The method of claim 5, wherein first information of a start point of a data area comprises the start point of the data area, and second information of a type of the PDF target pattern of the data area and an end point of the data area comprises the type of the PDF target pattern of the data area and the end point of the data area.

7. The method of claim 6, wherein setting a plurality of data areas that match a :PDF target pattern further comprises:

determining whether the line data is a last line data of the frame data; and storing an end point of a last data area of the last line data and a type of the PDF target pattern of the last data area, if the number of line data that matches the PDF target pattern is greater than a third setting value and the number of data areas set is less than the second setting value.

8. The method of claim 7, wherein when the line data does not match the :PDF target pattern or a pattern of the line data has been recognized, the method comprises determining whether the line data is the last line data of the frame data.

9. The method of claim 7, wherein when the number of line data that matches the PDF target pattern is less than the first setting value or the number of data areas set is greater than the second setting value, the method comprises determining whether the line data is the last line data of the frame data.

10. The method of claim 7, wherein when the line data does not match the PDF target pattern, or the number of line data that matches the PDF target pattern is less than the third setting value, or the number of line data set is greater than the second setting value, the method comprises applying an inversion driving technique independently to each data area.

11. The method of claim 5, wherein first information of a start point of a data area comprises the first-direction and second-direction location information of the start point of a data area, wherein the first and second directions are orthogonal to each other; and second information of a type of the PDF target pattern of the data area and an end point of the data area comprises the first-direction and second-direction location information of the end point of the data area and the type of the PDF target pattern of the data area.

12. The method of claim 11, wherein setting a plurality of data areas that match a PDF target pattern further comprises:

determining whether the line data is a last line data of the frame data; and storing the first-direction and second-direction location information of an end point of a last data area of the last line data and a type of the PDF target pattern of the last data area if: the number of line data that matches the PDF target pattern is greater than a third setting value, and the number of data areas set is less than the second setting value.

13. The method of claim 12, wherein when the line data does not match the PDF target pattern or a pattern of the line data has been recognized, the method comprises determining whether the line data is the last line data of the frame data.

14. The method of claim 12, wherein when the number of line data that matches the PDF target pattern is less than the first setting value or the number of data areas set is greater than the second setting value, the method comprises determining whether the line data is the last line data of the frame data.

15. The method of claim 12., wherein when the line data does not match the PDF target pattern, or the number of line data that matches the PDF target pattern is less than the third setting value, or the number of line data set is greater than the second setting value, the method comprises applying an inversion driving technique independently to each data area.

16. The method of claim 5, wherein first information of a start point of a data area comprises the first-direction and second-direction location information of each of a start and an intermediate point of a data area, wherein the first and second directions are orthogonal to each other; and second information of a type of the PDF target pattern of the data area and an end point of the data area comprises the first-direction and second-direction location information of the end point of the data area and the type of the PDF target pattern of the data area.

17. The method of claim 16, wherein there are a plurality of intermediate points.

18. A method of driving a liquid crystal display device, comprising:

analyzing a pattern type of line data of input frame data to determine a number of data that matches a pattern detect function (PDF) target pattern;

determining whether a number of line data that matches with a PDF target pattern is greater than a fourth setting value;

storing the line data as an object to which PDF is applied if: the number of line data that matches the PDF target pattern is greater than the fourth setting value;

storing the line data as an object to which PDF is not applied if: the number of line data that matches the PDF target pattern is less than the fourth setting value;

determining whether the line data is a last line data of the frame data;

applying the inversion driving technique independently to each line data if the line data is the last line data of the frame data;

analyzing a pattern type of line data of input frame data to determine the number of line data that matches a PDF target pattern, if the line data is not the last line data of the frame data;

applying two or more different inversion driving techniques independently to each line data with different patterns.

* * * * *